US005757332A

United States Patent [19]

Hanaoka et al.

[11] Patent Number: 5,757,332

[45] Date of Patent: May 26, 1998

[54] ELECTRONIC APPARATUS

[75] Inventors: Shunsuke Hanaoka; Hiroshi Asakawa, both of Tokyo, Japan

[73] Assignee: Sony Corporation, Tokyo, Japan

[21] Appl. No.: 563,072

[22] Filed: Nov. 27, 1995

[30] Foreign Application Priority Data

Dec. 12, 1994 [JP] Japan ..... 6-331448

[51] Int. Cl.[6] ..... H01Q 1/24

[52] U.S. Cl. ..... 343/787; 343/702; 343/718; 343/906

[58] Field of Search ..... 343/702, 718, 343/787, 788, 742, 744, 745, 906; H01Q 1/24, 1/50, 7/08

[56] References Cited

U.S. PATENT DOCUMENTS 4,754,285 6/1988 Robitaille ..... 343/718
4,922,260 5/1990 Gaskill et al. ..... 343/718

FOREIGN PATENT DOCUMENTS 728695 1/1945 Germany ..... 343/788
2202210 7/1972 Germany ..... 343/788

*Primary Examiner*—Michael C. Wimer
*Attorney, Agent, or Firm*—Jay H. Maioli

[57] ABSTRACT

An electronic apparatus has a demodulating section and a strap antenna having a conductor in its inside. Radio waves received by the strap antenna are demodulated by the demodulating section. A receiving-sensitivity adjustment member has at least one through hole for passing the strap antenna in it is slidably placed on the strap antenna, and since a magnetic substance built in the receiving-sensitivity adjustment member changes the electric field generated in the conductor of the strap antenna, receiving sensitivity can be adjusted to the most appropriate state. With an insulator member placed on the strap antenna, a loop antenna can be used as a monopole antenna. When the strap antenna is made detachable, another antenna can be used depending on the use condition.

9 Claims, 9 Drawing Sheets

ELECTRONIC APPARATUS

BACKGROUND OF THE INVENTION

1. Field of the Invention

The present invention relates to an electronic apparatus in which the receiving sensitivity of its strap antenna can be adjusted.

2. Description of the Related Art

TV receivers have been made compact and portable, and hence have been used outdoors. Such portable TV receivers and portable radios are carried with a strap, provided at the desired position on their housings, being pendent from the neck or the wrist of a person.

Since such a TV receiver needs an antenna for receiving broadcasting waves, it has been provided with a rod antenna or the like on its housing. According to the conditions under which the TV receiver is used, the direction the rod antenna or the like is placed and its length are adjusted in order to adjust receiving sensitivity. Since the rod antenna or the like is not integrated with the housing, it detracts from the appearance of the receiver. An idea has also been proposed that a strap can be used as an antenna by placing a conductor in the strap.

FIG. 13 is a perspective view illustrating the appearance of a portable TV receiver having a strap antenna.

In this figure, there is shown a portable TV receiver 1, the housing 2 of a receiver 1, and the strap antenna 3 extending from the corner of a housing 2. The strap antenna has a conductor inside the strap, thus serving as a strap and an antenna. As shown in FIG. 14, which is a perspective view of a part of the strap antenna, the strap antenna 3 is covered with a sheath 4 such as braids at its circumference. Under the sheath, a jacket 5 is formed with vinyl chloride or the like serving as water-proof means. At the center of the strap, a conductor 6 is provided as an antenna.

In FIG. 13, a display section 7, which shows an image, comprises, for example, a 4-inch small liquid crystal panel. There is also shown a power switch 8, a volume control key 9, a channel selection key 10, and a sound output section 11 for outputting the sound emitted from an internal speaker.

When a TV receiver has a strap in which an antenna for receiving broadcasting waves is built and it is used as both a strap and an antenna, the receiver looks simple while maintaining its conventional operations.

Since the strap antenna has a fixed length, it is impossible to adjust the length according to receiving conditions, unlike a rod antenna, and it is very difficult to adjust the receiving sensitivity to a suitable value.

Since the strap antenna 3 also serves as a strap, it must be loop shaped. It may thus change its shape during its operation because it is flexible. It therefore has a high probability of having an inappropriate shape for receiving radio waves, for example, a shape in which a signal induced in the antenna is canceled because the signal current flows in the opposite direction in parallel at different positions.

SUMMARY OF THE INVENTION

Accordingly, it is an object of the present invention to allow the receiving sensitivity of a strap antenna used in an electronic apparatus such as a portable TV receiver to be adjusted.

The above object of the present invention is achieved through the provision of an electronic apparatus configured such that radio waves received by a strap antenna which is made by passing a conductor inside a strap attached to the apparatus are demodulated by demodulating means included in the apparatus, the electronic apparatus comprising a receiving-sensitivity adjustment member in which a magnetic substance having at least one cylinder-shaped through hole is built, wherein the strap antenna is slidably passed through the through hole of the magnetic substance in the receiving-sensitivity adjustment member.

The strap antenna may be further provided with an insulator member at a specified position on the strap antenna, for electrically insulating a part of the strap antenna from the other part and for mechanically connecting them.

The magnetic substance built in the receiving-sensitivity adjustment member may be formed with a core having two through holes.

The electronic apparatus may be configured such that the magnetic substance built in the receiving-sensitivity adjustment member is formed with a core having two through holes and the strap antenna is further provided with an insulator member at a specified position on the strap antenna, for mechanically electrically insulating a part of the strap antenna from the other part and for connecting them.

The above object of the present invention is also achieved through the provision of an electronic apparatus configured such that radio waves received by a strap antenna which is made by passing a conductor inside a strap attached to the apparatus are demodulated by demodulating means included in the apparatus, wherein an insulator member for electrically insulating a part of the strap antenna from the other part and for connecting them is placed at a specified position on the strap antenna.

The strap antenna may be further provided with a receiving-sensitivity adjustment member in which a magnetic substance having at least one cylinder-shaped through hole is built.

The insulator member may be provided with switching means for selectively switching between an insulating state and a connecting state of the strap antenna.

The electronic apparatus may be configured that the insulator member is provided with switching means for selectively switching between the insulating state and the connecting state of the strap antenna and the strap antenna is further provided with a receiving-sensitivity adjustment member in which magnetic substance having at least one cylinder-shaped through hole is built.

The above object of the prevent invention is also achieved through the provision of an electronic apparatus comprising a main body and a separate antenna base, wherein the main body is formed such that the separate antenna base is integral to the main body, the main body comprising at least: an antenna terminal for receiving signals supplied from the antenna base; and demodulating means for demodulating the signals received through the antenna terminal, and the antenna base comprising: a strap antenna structured with a conductor passing inside a strap; and an antenna plug for supplying the signals received by the strap antenna to the antenna terminal.

The above object of the prevent invention is also achieved through the provision of an electronic apparatus comprising a main body and a separate antenna base, wherein the main body is formed such that the separate antenna base is integral to the main body, the main body comprising: an antenna-base securing section for rotatably supporting the antenna base; a contact provided on the main body for receiving the signals supplied from the antenna base; and demodulating means for demodulating the signals received through the contact, and the antenna base comprising: a strap antenna structured with a conductor passing inside a strap and configured such that a first antenna section and a second antenna section are formed by electrically insulating them from each other at the specified position by an insulator member; and a first contact and a second contact provided on a surface facing the antenna-base securing section and connected to the ends of the first antenna section and the second section, wherein the contact provided on the main body is connected to either of the first contact and the second contact by rotating the antenna base.

When the strap antenna is provided with the receiving-sensitivity adjustment member and the insulator member, receiving sensitivity can be adjusted in the same way as for a rod antenna or the like with a simple design being maintained.

By making the strap antenna detachable, the most appropriate antenna can be mounted for receiving depending on the usage.

In the electronic apparatus, since the loop strap antenna extended from the housing passes through the receiving-sensitivity adjustment member in which the magnetic substance is built such that the magnetic substance absorbs the electric field, receiving sensitivity can be adjusted. With this configuration, one of the features of the strap antenna, simpler appearance than that of, for example, a rod antenna, is made the best use of, and sensitivity can be adjusted in the same way as the length of a rod antenna is adjusted.

Because the insulator member for electrical insulation can be placed at the specified position on the strap antenna, the antenna can be used as a monopole antenna. When the insulator member is provided with the connection switching means, the antenna can be used as a loop antenna or a monopole antenna.

When the antenna base from which the strap antenna is extended is made detachable, an outdoor antenna, an external rod antenna, or other antenna can be connected depending on the use condition.

DETAILED DESCRIPTION OF THE PREFERRED EMBODIMENTS

Electronic apparatuses according to preferred embodiments of the present invention will be described below by referring to FIGS. 1 to 12. A first embodiment will be described first by referring to FIGS. 1 to 4, a second embodiment will be described next by referring to FIGS. 5 to 7, and then a third embodiment will be explained by referring to FIGS. 8 to 12.

Figure 1A:
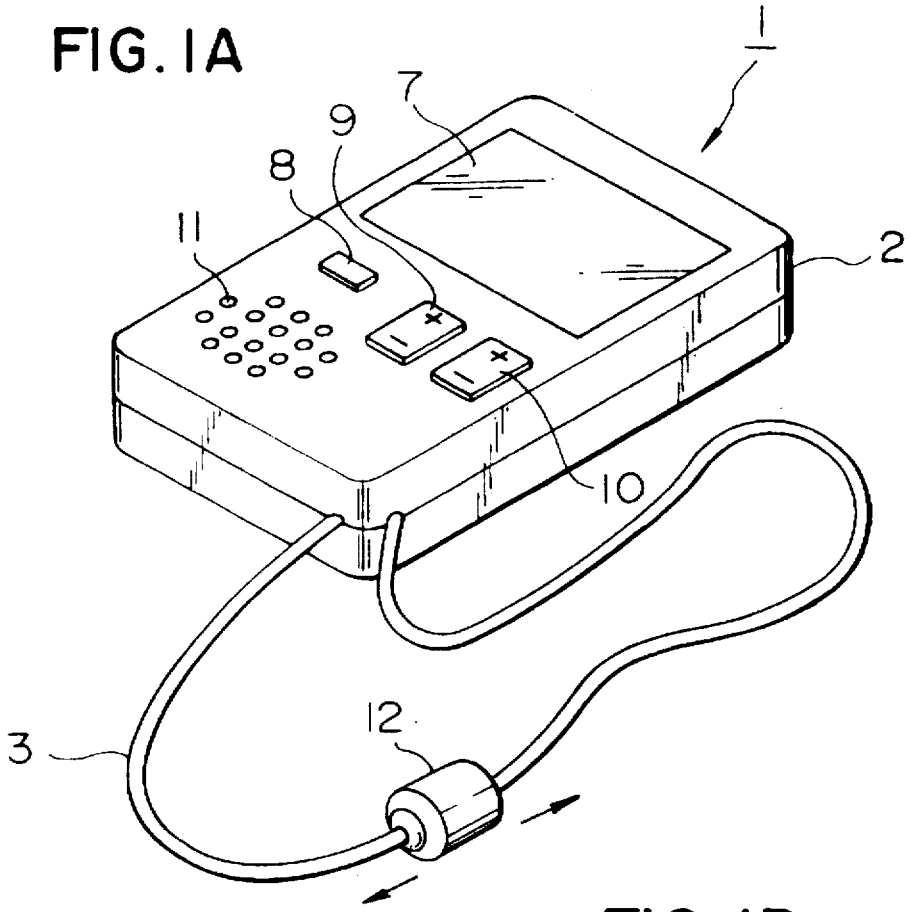
FIG. 1A shows a portable TV receiver according to a first embodiment of the present invention.
Figure 1B:
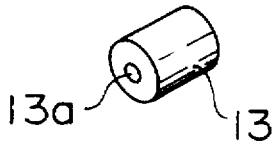
FIG. 1B is a perspective view of a magnetic substance used in the receiving-sensitivity adjustment section of the receiver shown in FIG. 1A.
Figure 13:
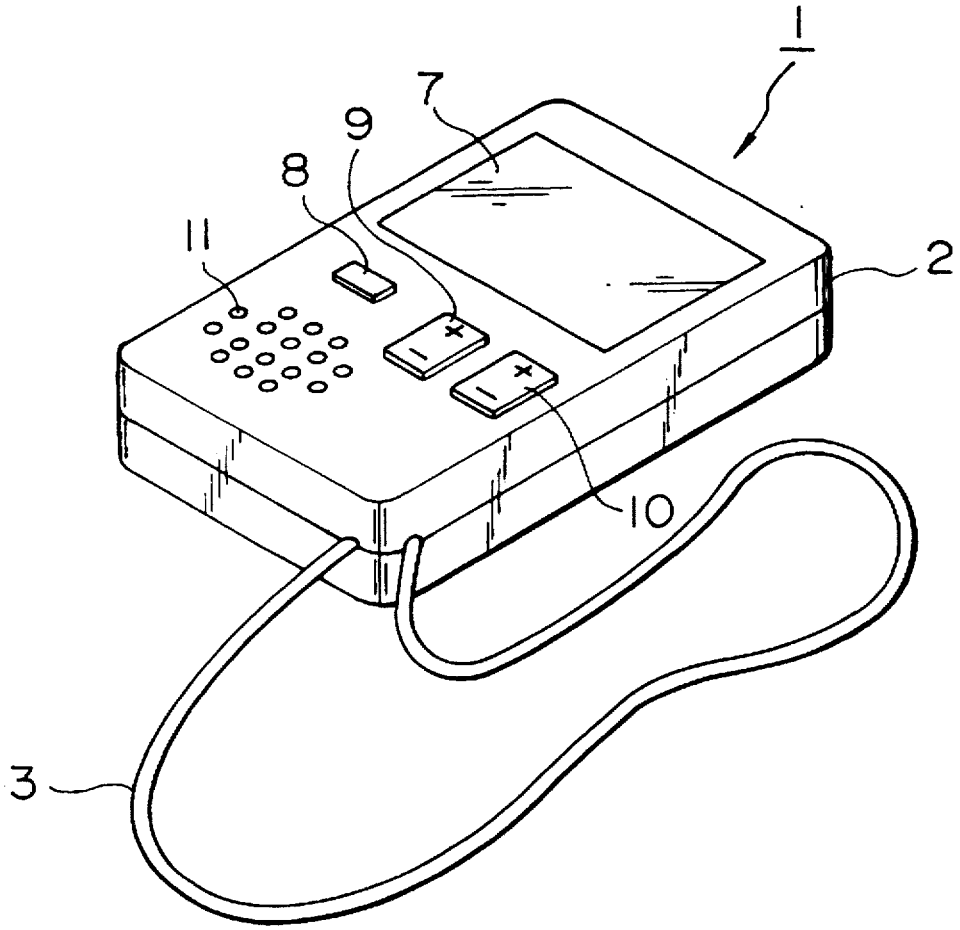
FIG. 13 (PRIOR ART)
FIG. 13 is a perspective view of the conventional portable TV receiver.
Figure 14:
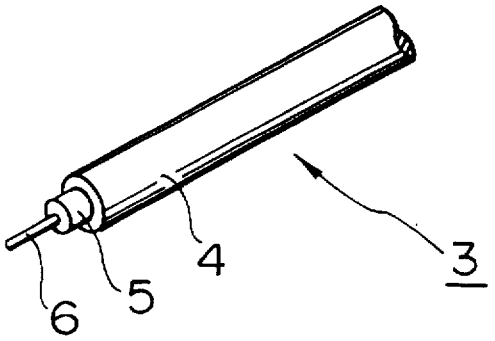
FIG. 14 (PRIOR ART)
FIG. 14 shows the structure of a strap antenna used for the receiver.

FIG. 1A is a perspective view of a portable TV receiver according to the first embodiment of,the present invention. In this figure, there is shown a portable TV receiver 1, a housing 2, a strap antenna 3, a display section 7, a power switch 8, a volume adjustment key 9, a channel selection key 10, and a sound output section 11, in the same way as the conventional portable TV receiver, shown in FIG. 13. A receiving-sensitivity adjustment section 12 is provided in the present invention such that it can slide along the strap antenna 3 in any of the directions shown in the figure. The receiving-sensitivity adjustment section 12 has a magnetic substance 13 (such as a ferrite core) shown in FIG. 1B within the section. The magnetic substance 13 is formed like a cylinder and has a through hole 13*a*. The receiving sensitivity can be adjusted to set it to the most suitable value by moving the adjustment section 12 in any of the directions shown in the figure on the strap antenna to change the state of a standing wave received by the strap antenna 3 while watching the display section of the receiver.

Figure 2:
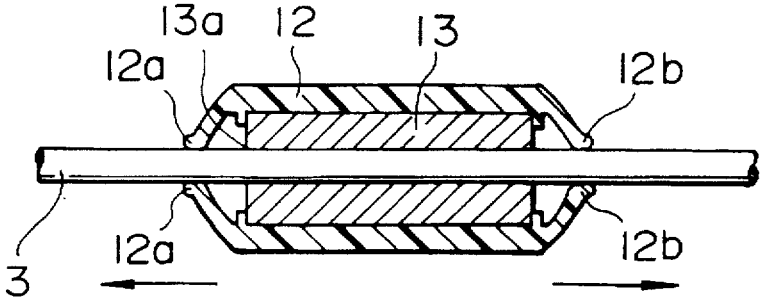
FIG. 2 is a cross section of the receiving-sensitivity adjustment section according to the first embodiment.

FIG. 2 is a cross section of the receiving-sensitivity adjustment section 12.

In FIG. 2, fitting sections 12*a* and 12*b* are formed at both ends of the receiving-sensitivity adjustment section 12 such that they press the strap antenna 3. In other words, the receiving-sensitivity adjustment section 12 is tentatively secured at a place on the strap antenna by friction force caused by the pressure of the fitting sections 12*a* and 12*b* against the strap antenna. Applying a force exceeding the friction force to the adjustment section 12 slides the section in the direction in which the force is applied.

A magnetic substance 13, such as a ferrite core, is formed in a cylinder shape and placed inside the receiving-sensitivity adjustment section 12. At the center of the magnetic substance 13, a through hole 13 having a circumference substantially the same as the outside circumference of the strap antenna 3 is formed. The strap antenna 3 is inserted into this through hole.

With the structure described above in which the receiving-sensitivity adjustment section 12 comprises the magnetic substance 13, since the magnetic field generated on the conductor 6 in receiving radio waves is absorbed at the position where the receiving-sensitivity adjustment section 12 is placed on the strap antenna, the receiving sensitivity changes. By sliding the receiving-sensitivity adjustment section 12 in one of the directions indicated by the arrows in the figure, since the state of the standing waves of radio waves received by the strap antenna changes with the magnetic substance 13, this structure has substantially the same advantages as when the most suitable image is received by adjusting the length of the rod antenna in the conventional apparatus.

Figure 3A:
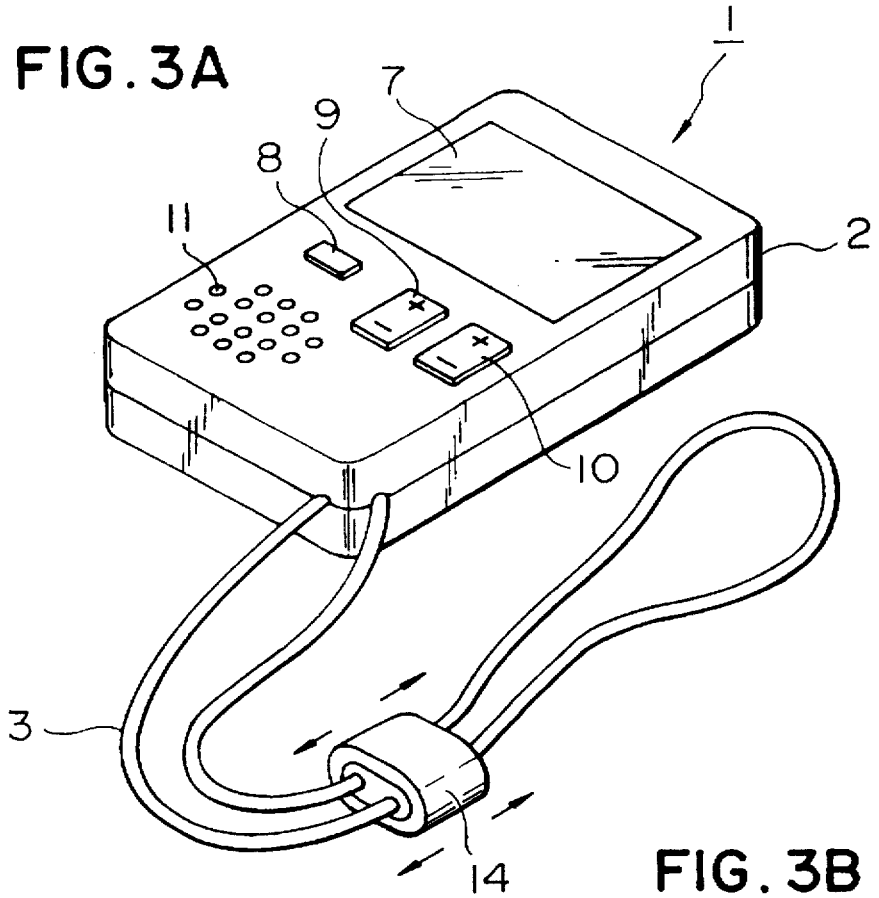
FIG. 3A shows a portable TV receiver according to another example of the first embodiment.
Figure 3B:
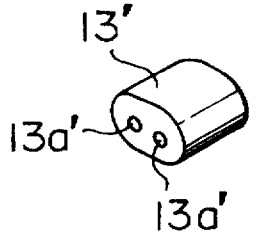
FIG. 3B is a perspective view of a magnetic substance used in the receiving-sensitivity adjustment section of the receiver shown in FIG. 3A.
Figure 4:
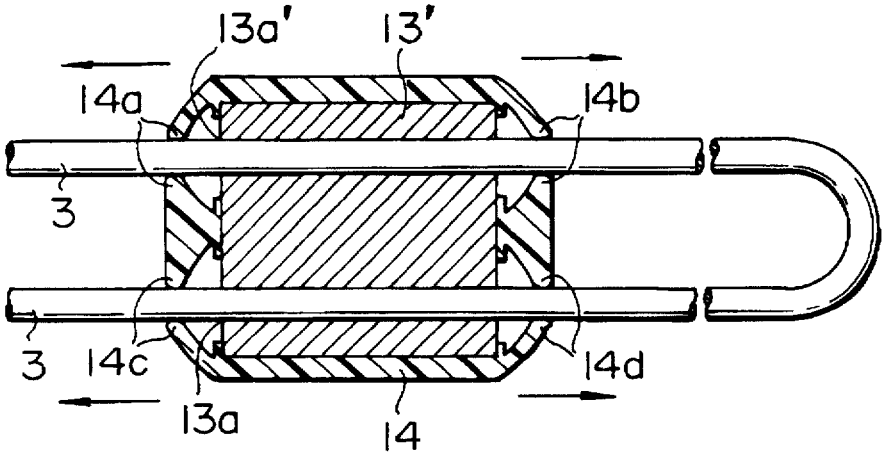
FIG. 4 is a cross section of the receiving-sensitivity adjustment section of the receiver.

FIGS. 3A, 3B, and 4 show another example of the first embodiment.

FIG. 3A is a perspective view of the portable TV receiver 1. In FIG. 3A, a receiving-sensitivity adjustment section 14 includes a magnetic substance 13' shown in FIG. 3B. The substance 13' is formed in a shape of a pair of binoculars with two units of the magnetic substance 13, as was shown in FIG. 2. The strap antenna 3 is inserted into through holes 13*a*'. The receiving sensitivity can be adjusted by sliding the adjustment section 14 in any of the directions indicated by the arrows in the figure.

FIG. 4 is a cross section of the receiving-sensitivity adjustment section 14. In FIG. 4, there is shown a magnetic substance 13' built in the receiving-sensitivity adjustment section 14. Fitting sections 14*a*, 14*b*, 14*c*, and 14*d* are used to secure the adjustment section 14 on the strap antenna 3 in the same way as the fitting sections 12*a* and 12*b*, shown in FIG. 2, do.

In this example, receiving sensitivity is adjusted by sliding the magnetic substance 13', which is similar to the magnetic substance shown in FIG. 2 and is built in the receiving-sensitivity adjustment section 14, along the strap antenna 3, which is inserted to the through holes 13*a*' and 13*b*'.

This method of adjusting receiving sensitivity is the same as that described for FIGS. 1 and 2. Sliding the receiving-sensitivity adjustment section 14 along the strap antenna in any of the directions indicted by the arrows in the figure adjusts receiving sensitivity. Pulling a part of the strap antenna 3 passing through the through holes 13*a*' in any of the indicated directions while the receiving-sensitivity adjustment section 14 is held, for example, in the user's hands also adjusts receiving sensitivity.

A second embodiment will be described below by referring to FIGS. 5 to 7.

Figure 5:
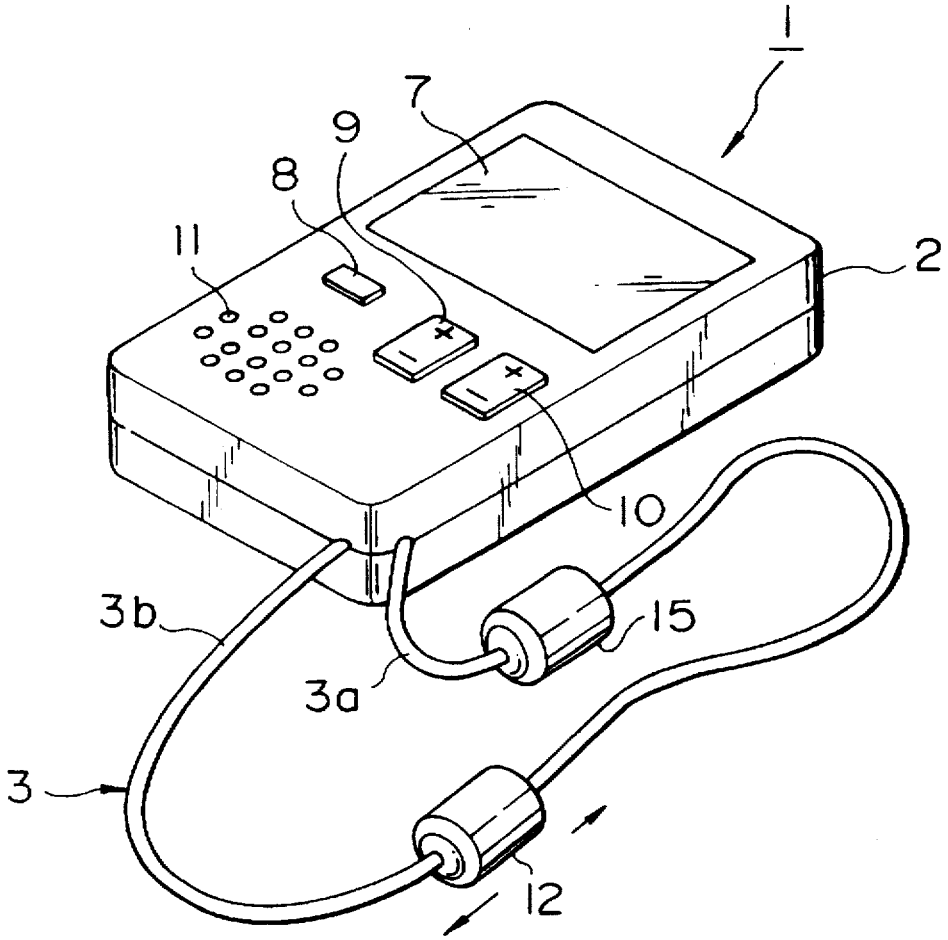
FIG. 5 shows a portable TV receiver according to a second embodiment of the present invention.

FIG. 5 is a perspective view of a portable TV receiver according to the second embodiment of the present invention. The same portions as those shown in FIG. 1 have the same symbols and their descriptions are omitted here. In this embodiment, an insulator member 15 is formed at the desired position on the strap antenna 3 for insulating electricity. With the loop shape of the strap antenna 3 being maintained, the antenna is divided into two parts, an antenna section 3*a* and an antenna section 3*b*, by the insulator member 15 and serves as a monopole antenna. The antenna section 3*a* is not connected to the antenna terminal of the TV receiver 1.

Figure 6:
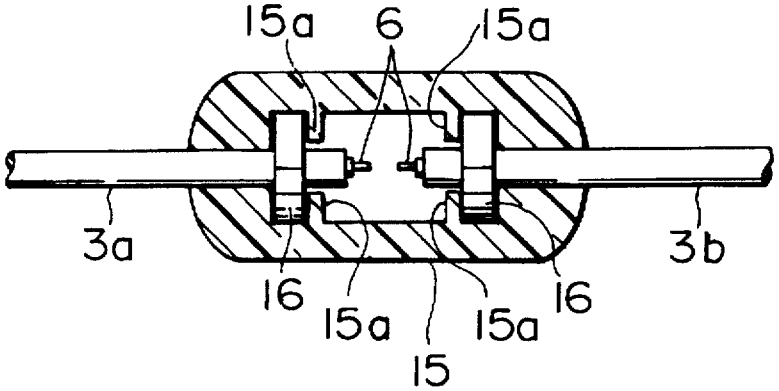
FIG. 6 is a cross section of the receiving-sensitivity adjustment section of the receiver.

FIG. 6 is a cross section of the insulator member 15, shown in FIG. 5. In FIG. 6, stoppers 16 secure the insulator member 15 on the antenna sections 3*a* and 3*b*. Ends of the antenna sections 3*a* and 3*b* pass through the stoppers 16. The stoppers 16 are secured to locking sections 15*a* of the insulator member 15. The loop shape of the strap antenna 3 is maintained with the stoppers 16 and the locking sections 15*a*, allowing the antenna to also serve as a strap.

With electrical insulation by the insulator member 15, the antenna section 3*b* can be used as a monopole antenna or a dipole antenna. In addition, receiving sensitivity is adjusted by moving the receiving-sensitivity adjustment section 12 in any of the directions indicated by the arrows on the antenna section 3*b*.

A strap not having members such as the conductor 6 composing an antenna may be used for the antenna section 3*a*, which is not connected to the antenna terminal of the TV receiver 1.

The strap antenna 3 can be switched between a monopole antenna and a loop antenna by providing the insulator member 15 with switching means.

Figure 7A:
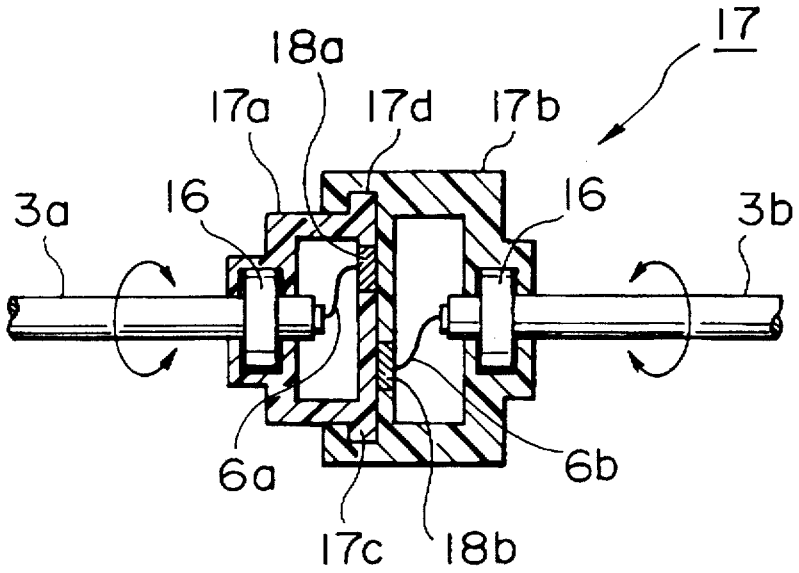
FIGS. 7A and 7B are cross sections of a receiving-sensitivity adjustment section according to another example of the second embodiment.
Figure 7B:
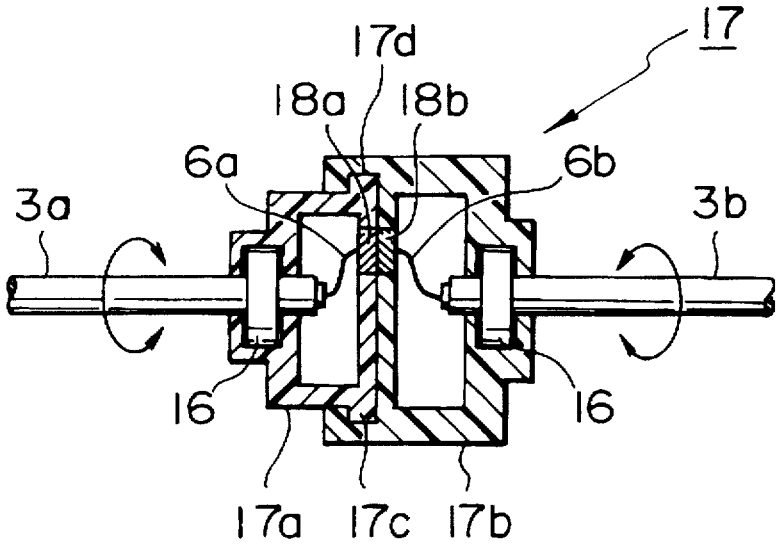

FIGS. 7A and 7B show an example of an insulator member having a switching function on the strap antenna 3 as another example of the second embodiment. Both antenna sections 3*a* and 3*b* are connected to the antenna terminals of the receiver 1.

In these figures, there is shown an insulator member 17, antenna holding sections 17*a* and 17*b* composing the insulator member 17, a flange section 17*c* provided at an end of the antenna holding section 17*a*, and a fitting groove 17*d* formed at the antenna holding section 17*b*. By fitting the flange section 17*c* into the fitting groove 17*d*, the antenna section 17*a* is connected to the antenna section 17*b* such that they are rotatable in any of the directions indicated by the arrows.

A contact 18*a* formed on the antenna holding section 17*a* is connected to the conductor 6*a* extended from the antenna section 3*a*. A contact 18*b* formed on the antenna holding section 17*b* is connected to the conductor 6*b* extended from the antenna section 3*b*. As described in FIG. 6, the antenna sections 3*a* and 3*b* are secured to the antenna holding sections 17*a* and 17*b* with the stoppers 16.

As shown in FIG. 7A, for example, when the contacts 18*a* and 18*b* are not connected, the antennas 3*a* and 3*b* can be used as a monopole antenna.

When the antenna holding section 17*b* is rotated to change the state shown in FIG. 7A to that shown in FIG. 7B, that is, the state in which the contacts 18*a* and 18*b* are connected, the conductor 6*a* extended from the antenna section 3*a* is connected to the conductor 6*b* extended from the antenna section 3*b*, forming a loop antenna with the antenna sections 3*a* and 3*b*.

Even when the insulator member 17 is used, providing the antenna section 3*a* and/or the antenna section 3*b* with the receiving-sensitivity adjustment section 12 allows receiving sensitivity to be adjusted as shown in the first embodiment.

A third embodiment of the present invention will be described below by referring to FIGS. 8 to 10. In the third embodiment, the strap antenna 3 and the housing 2 are separate units and the antenna 3 is made detachable.

Figure 8:
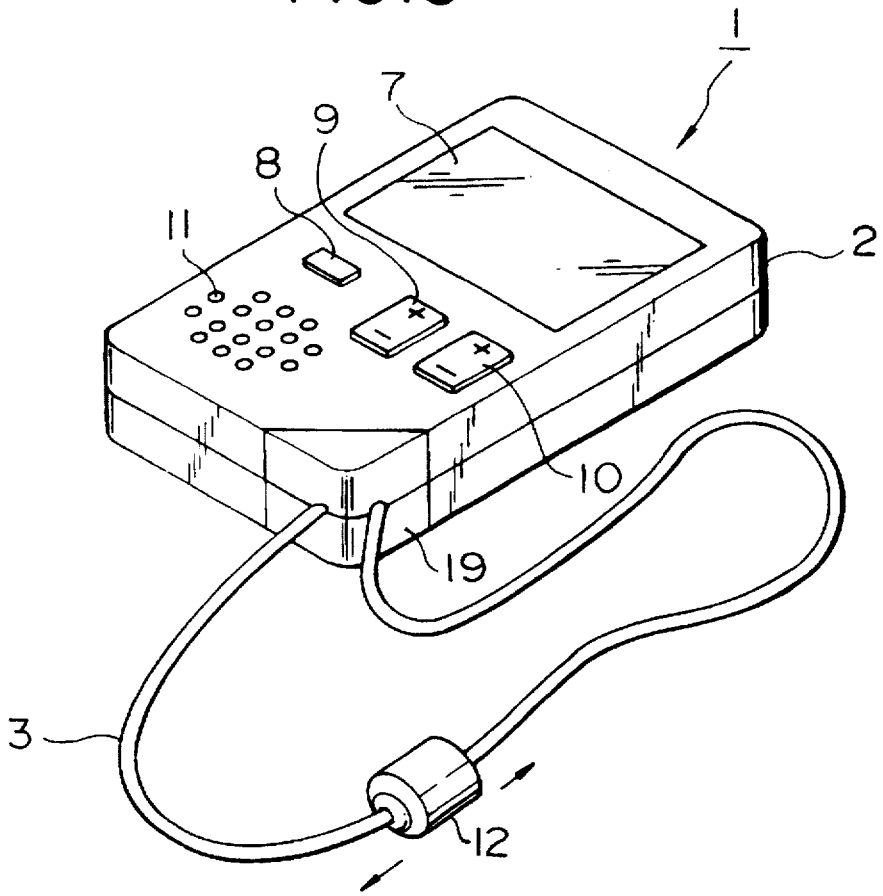
FIG. 8 shows a portable TV receiver according to a third embodiment of the present invention.

FIG. 8 is a perspective view of a portable TV receiver according to the third embodiment. The strap antenna 3, which serves as a loop antenna, is extended from an antenna base 19. When the base 19 is mounted to the housing 2 as shown in the figure, it forms a corner of the housing 2. As described later by referring to FIG. 9, the base 19 is provided with an antenna terminal at its surface facing the housing 2 in order to connect the antenna to the tuner built in the housing 2.

Providing the receiving-sensitivity adjustment section 12 allows receiving sensitivity to be adjusted by sliding the adjustment section 12 on the strap antenna 3, in the same way as for the first and second embodiments. In addition, providing the insulator member 15 (not shown) used in the second embodiment enables the antenna to serve as a monopole antenna. Providing the insulator member 17 allows the antenna to be switched between a loop antenna and a monopole antenna.

Figure 9:
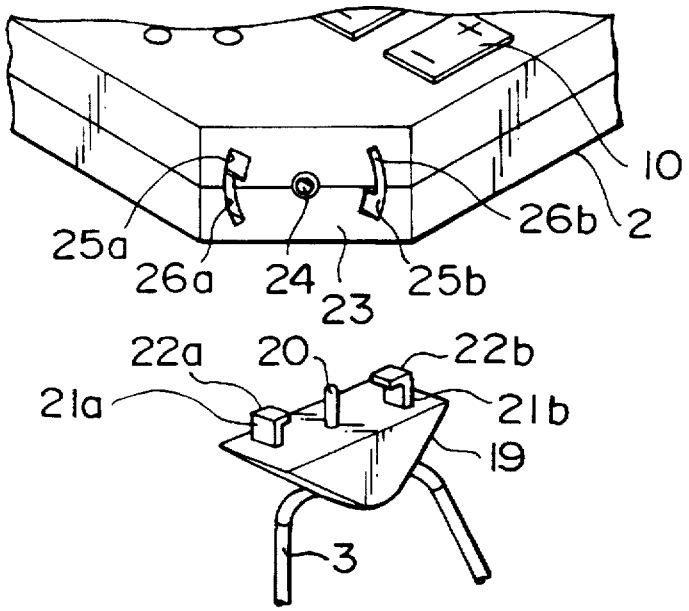
FIG. 9 shows the antenna base and the antenna-base mounting section of the third embodiment.

FIG. 9 shows a part of the portable TV receiver, shown in FIG. 8, in which the housing 2 and the antenna base 19 are detached from each other.

In this figure, an antenna jack 20, such as a mini-jack, is protruded at the center of the surface of the antenna base 19 facing the housing 2. A pair of locking blocks 21*a* and 21*b* has locking sections 22*a* and 22*b* at its tips, respectively. The arc-shaped locking blocks 21*a* and 21*b* are protruded on a circle with its center being at the antenna jack 20, and are put in entry holes on the housing 2. With the locking blocks 21*a* and 21*b*, the antenna base 19 is secured to the housing 2.

An antenna mounting section 23 is formed at a corner of the housing 2 of the portable TV receiver 1. The antenna jack 20 is inserted into an antenna plug 24 formed at the center of the antenna mounting section 23. When the antenna jack 20 is inserted into the antenna plug 24, the locking blocks 21*a* and 21*b* are fit into entry holes 25*a* and 25*b* formed at the opposite positions against those of the locking blocks 21*a* and 21*b*. Locking slots 26*a* and 26*b* are extended from the entry holes 25*a* and 25*b*. These slots 26*a* and 26*b* are formed with a width smaller than that of the locking sections 22*a* and 22*b* to lock them.

Corresponding to the locking blocks 21*a* and 21*b*, the entry holes 25*a* and 25*b* and the locking slots 26*a* and 26*b* are formed on a circle in an arc shape with the antenna plug 24 being at the center.

To mount the antenna base 19 on the antenna mounting section 23, the tip of the antenna jack 20 is inserted into the antenna plug 24 for positioning, and then the locking sections 22*a* and 22*b* are fit in the entry holes 25*a* and 25*b*, and the antenna jack 20 is completely inserted into the antenna plug 24. The antenna base 19 is rotated so that ends of the locking blocks 21*a* and 21*b* abut against the ends of the locking slots 26*a* and 26*b*. Then, the locking sections 22*a* and 22*b* are locked by the locking slots 26*a* and 26*b*, securing the antenna base 19 to the housing 2 as shown in FIG. 8.

Since the apparatus is configured such that the antenna base 19 is integral to the housing 2, the appearance of the TV receiver 1 is made simple.

Figure 10A:
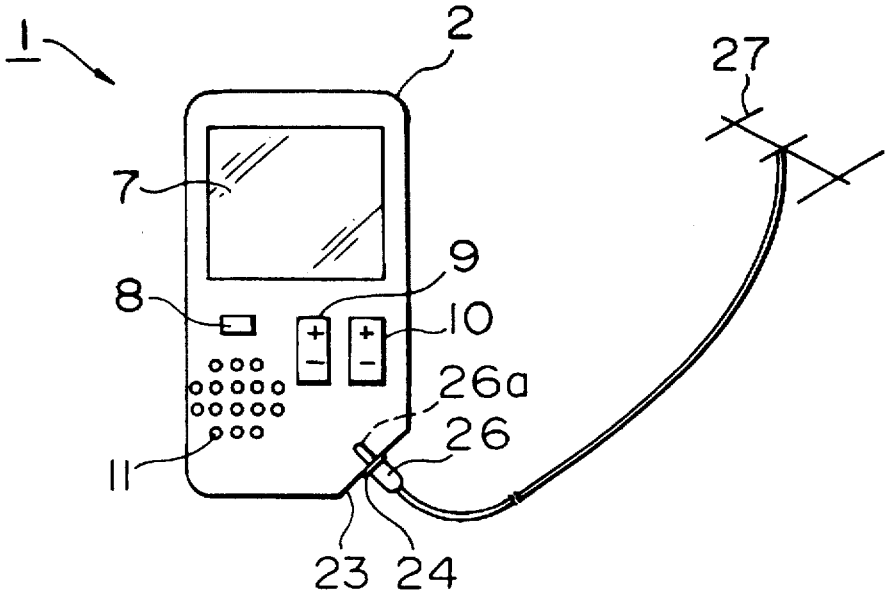
FIG. 10A shows the portable TV receiver according to the third embodiment to which another antenna is mounted.
Figure 10B:
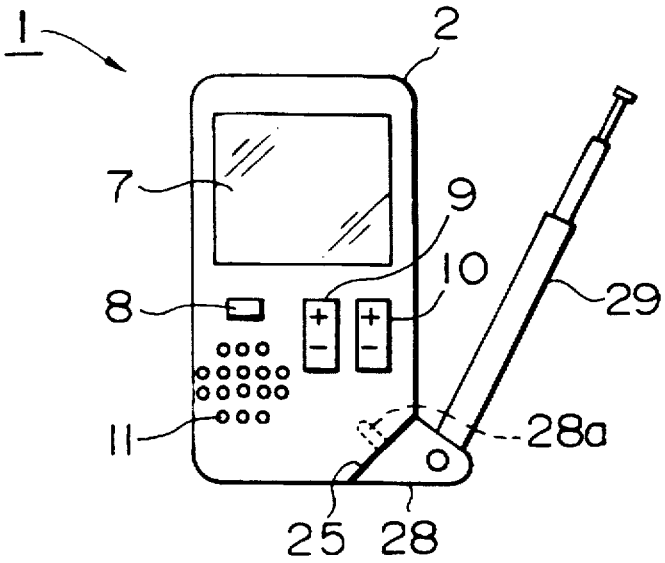
FIG. 10B shows the portable TV receiver according to the third embodiment to which still another antenna is mounted.

By making the strap antenna 3 detachable as shown in FIGS. 10A and 10B, an antenna of other types can be connected depending on the condition.

To watch a TV program indoors, the antenna jack 26 of an outdoor antenna 27 is connected to the antenna plug 24 of the housing 2 as shown in FIG. 10A. This allows a broadcast program to be received by the outdoor antenna 27.

Connecting the antenna jack 28 of an external rod antenna 29, instead of the strap antenna 3, to the antenna plug 24 allows the user to watch a broadcast program received by the rod antenna 29 even outdoors, as shown in FIG. 10B.

As described above, by making the strap antenna 3 detachable, broadcasting waves can be received with the most appropriate antenna according to the situation, enabling a program to be received in a better condition.

When the antenna base 19 is rotatably secured to the housing 2 with its mount structure being changed, and the strap antenna 3 is divided into two parts with the insulator member 15, described in FIG. 5, to form the two isolated antennas having different lengths, one of the two long and short monopole antennas can be selectively used.

Figure 11:
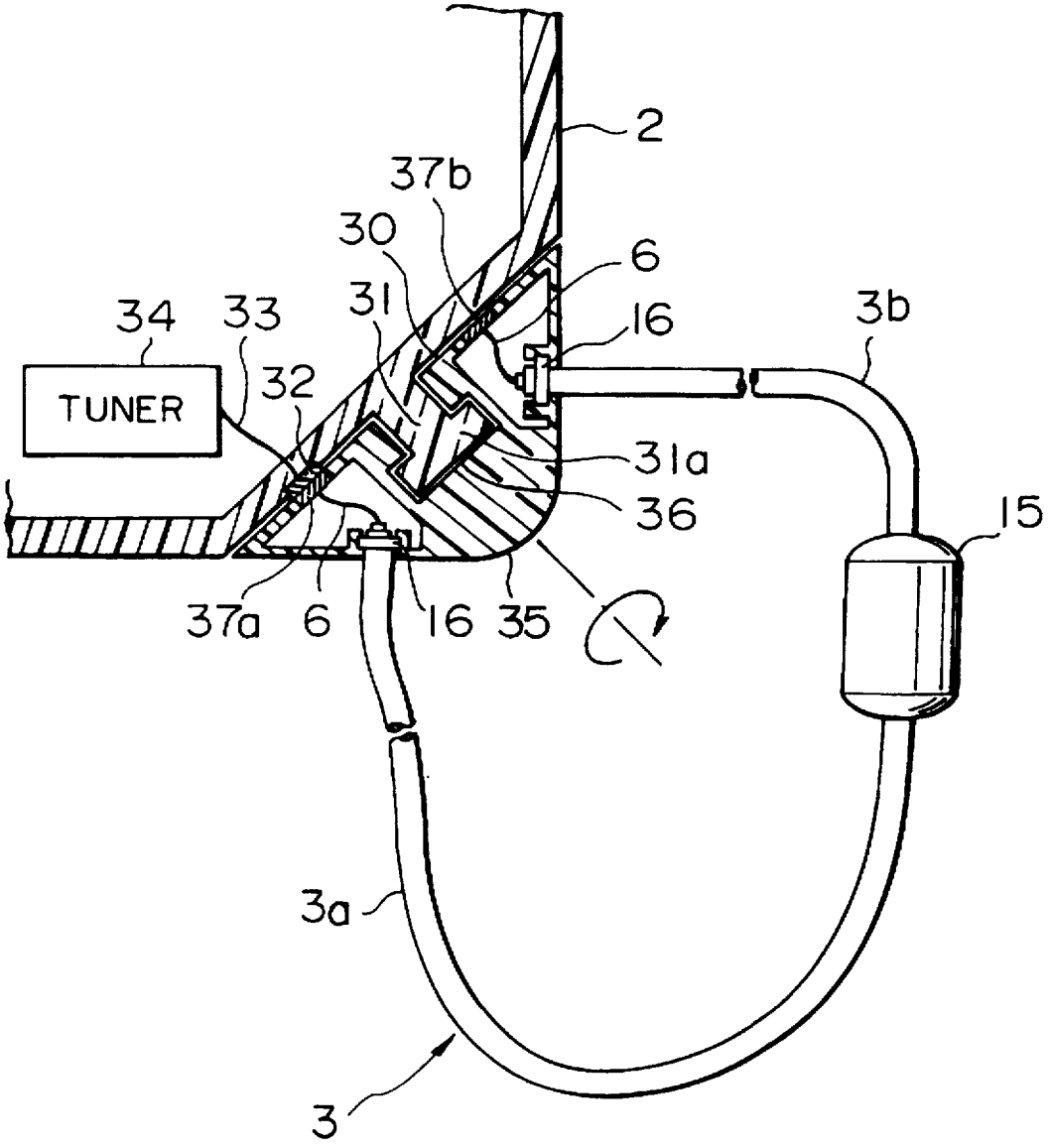
FIG. 11 is a partial enlarged view of a portable TV receiver according to a fourth embodiment of the present invention.

FIG. 11 is a cross section of part of a housing 2 to which a rotatable antenna base is secured according to a fourth embodiment. In this figure, there is shown an antenna-base securing section formed at a corner of the housing 2 and a support 31 protruded at the center of the antenna base and provided with an engagement section 31*a* at its tip. A contact 32 formed on the antenna-base securing section 30 is connected with a conductor 33 to a tuner 34 built in the housing 2.

There is also shown an antenna base 35 from which the antenna sections 3*a* and 3*b* having different lengths insulated by an insulator member 15 are extended, an engagement recess 36 to which is mated the engagement section 31*a* of the support 31 protruded from the antenna-base securing section 30, and contacts 37*a* and 37*b* formed on the antenna base 35. The contacts 37*a* and 37*b* are formed correspondingly to the contact 32 on the antenna-base securing section 30 and are connected to the conductor 6 extended from the antenna sections 3*a* and 3*b*. This figure shows the state in which the contacts 32 and 37*a* are connected. Rotating the antenna base 35 about the support 31 by 180 degrees connects the contact 32 to the contact 37*b*.

Figure 12A:
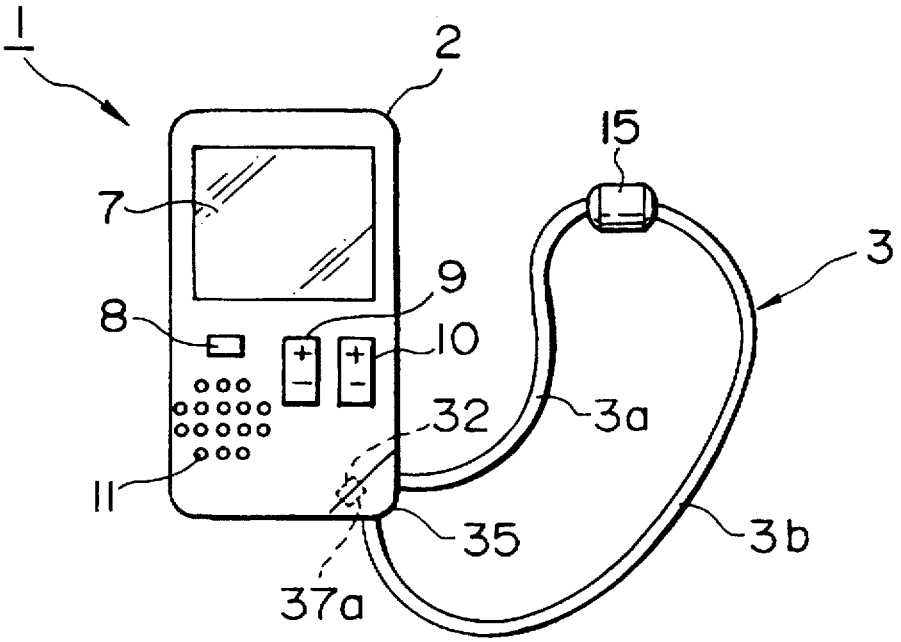
FIGS. 12A and 12B show how the receiving sensitivity is adjusted in the fourth embodiment.
Figure 12B:
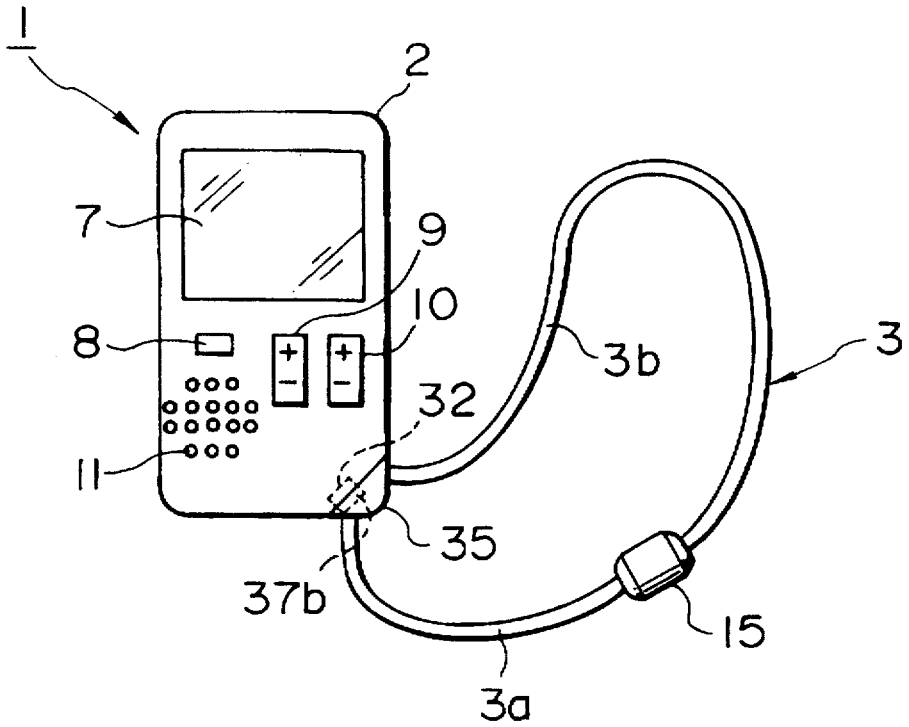

FIGS. 12A and 12B show a portable TV receiver comprising the housing 2 and the antenna base 35 shown in FIG. 11. The strap antenna 3 shown in this figure is divided into a long antenna section 3*a* and a short antenna section 3*b* by the insulator member 15, each of which serves as a monopole antenna.

In FIG. 12A, which shows the same state as in FIG. 11, broadcasting waves are received by the antenna section 3*a* because the contact 32 is connected to the contact 37*a*. When the antenna base 35 is rotated in this condition; the contact 32 is connected to the contact 37*b* as shown in FIG. 12B. Then, broadcasting waves are received by the antenna section 3*b*.

By rotating the antenna base 35 by 180 degrees as required, whichever antenna provides better sensitivity is selected of the two antenna sections 3*a* and 3*b* having different lengths.

When the antenna sections 3*a* and 3*b* are provided with two units of the receiving-sensitivity adjustment section 12 (not shown), fine sensitivity adjustment can be performed by selecting with the antenna base 35 the antenna section (3*a* or 3*b*) having a better sensitivity and sliding the adjustment member 12 on the selected antenna section.

The first to fourth embodiments describe the portable TV receivers. The present invention can also be applied to apparatuses which provide images and/or sounds by demodulating radio waves received by an antenna.

What is claimed is:

1. An electronic apparatus in which radio waves are received by a strap antenna formed by passing a conductor inside a flexible carrying strap attached to said apparatus and are demodulated, said electronic apparatus comprising a receiving-sensitivity adjustment member formed of a cylindrically shaped magnetic substance having at least one cylinder-shaped through hole arranged in a cylindrical case having fitting sections at each end, wherein said strap antenna is slidably passed through said fitting sections of said case and said through hole of said magnetic substance in said receiving-sensitivity adjustment member, wherein said fitting sections exert a frictional force on said strap so that said receiving-sensitivity adjustment member can be slid to a position along a length of said strap antenna and retained at said position by the frictional force.

2. An electronic apparatus according to claim 1, wherein said magnetic substance in said receiving-sensitivity adjustment member is formed with said magnetic substance having two through holes and said case having a pair of said fitting sections at each end.

3. An electronic apparatus according to claim 1, wherein said conductor is interrupted along a length thereof to form first and second conductor portions and said strap antenna is further provided with an insulator member at a position along said strap antenna whereat said conductor is interrupted for electrically insulating an end of said first conductor portion from an end of said second conductor portion and for mechanically connecting them.

4. An electronic apparatus according to claim 1, wherein said magnetic substance in said receiving-sensitivity adjustment member is formed with two through holes, wherein said conductor is interrupted along a length thereof to form first and second conductor portions and said strap antenna is further provided with an insulator member at a specified position along said strap antenna for electrically insulating one end of said first conductor portion from one end of said second conductor portion and for mechanically connecting them.

5. An electronic apparatus in which radio waves received by a strap antenna formed by passing a conductor inside a flexible carrying strap attached to said apparatus are demodulated, wherein said conductor is interrupted along a length thereof to form first and second conductor portions and including an insulator member for electrically insulating one end of said first conductor portion from one end of said second conductor portion and for mechanically connecting said first conductor portion and said second conductor portion and being placed at a specified position along said strap antenna, wherein said insulator member is provided with switching means for selectively switching between an insulating state wherein said one ends of said first and second conductor portions are mutually isolated and form monopole antennas and a connecting state wherein said one ends of said first and second conductors are electrically connected.

6. An electronic apparatus according to claim 5, wherein said strap antenna is further provided with a receiving-sensitivity adjustment member in which a magnetic substance having at least one cylinder-shaped through hole is built.

7. An electronic apparatus in which radio waves received by a strap antenna formed by passing a conductor inside a flexible carrying strap attached to said apparatus are demodulated, wherein said conductor is interrupted along a length thereof to form first and second conductor portions and including an insulator member for electrically insulating one end of said first conductor portion from one end of said second conductor portion and for mechanically connecting said first conductor portion and said second conductor portion and being placed at a specified position along said strap antenna, wherein said insulator member is provided with switching means for selectively switching between electrically insulating said one end of said first conductor portion from said one end of said second conductor portion and electrically connecting said one end of said first conductor portion to said one end of said second conductor portion and said strap antenna is further provided with a receiving-sensitivity adjustment member in which a magnetic substance having at least one cylinder-shaped through hole has said strap antenna passed therethrough for being slidingly located along said strap.

8. An electronic apparatus comprising a main body and a separate antenna base, wherein said main body is formed such that said separate antenna base is integrally fitted to said main body, said main body comprising:

an antenna jack for receiving signals supplied from said antenna base;

demodulating means for demodulating the signals received through said jack; and locking slots formed in said main body, and said antenna base comprising:

a strap antenna having a conductor passing inside a strap;

an antenna plug for fitting into said jack and supplying signals received by said strap antenna to said demodulating means; and locking blocks for cooperating with said locking slots and attaching said antenna base to said main body.

9. An electronic apparatus comprising a main body and a separate antenna base, wherein said main body is formed such that said separate antenna base is integrally fitted to said main body, said main body comprising:

an antenna-base securing section for rotatably supporting said antenna base;

a contact provided on said main body for receiving signals supplied from said antenna base; and demodulating means for demodulating the signals received through said contact, and said antenna base comprising:

a strap antenna having a conductor passing inside a strap and being formed of a first antenna section and a second antenna section electrically insulated from each other at a specified position by an insulator member; and a first contact and a second contact provided on a surface facing said antenna-base securing section and connected respectively to ends of said first antenna section and said second section, wherein said contact provided on said main body is connected to either of said first contact and said second contact by rotating said antenna base relative to said main body.

* * * * *